US007267510B2

(12) United States Patent
Dimitrijevic

(10) Patent No.: US 7,267,510 B2
(45) Date of Patent: Sep. 11, 2007

(54) FOUNDATION PILE HAVING A SPIRAL RIDGE

(75) Inventor: Mark Dimitrijevic, Houston, TX (US)

(73) Assignee: Cable Lock, Inc., Houston, TX (US)

( * ) Notice: Subject to any disclaimer, the term of this patent is extended or adjusted under 35 U.S.C. 154(b) by 0 days.

(21) Appl. No.: 10/629,100

(22) Filed: Jul. 29, 2003

(65) Prior Publication Data

US 2005/0025576 A1 Feb. 3, 2005

(51) Int. Cl.
*E02D 5/10* (2006.01)
*E02D 27/12* (2006.01)
*E04C 3/34* (2006.01)

(52) U.S. Cl. ..... 405/256; 405/252.1; 52/294; 52/721.3

(58) Field of Classification Search ..... 405/231, 405/232, 250, 251, 252, 252.1, 256, 230, 405/233, 235, 254; 52/169.9, 721.3, 721.2, 52/724.1, 294
See application file for complete search history.

(56) References Cited

U.S. PATENT DOCUMENTS

| | | | | | |
|---|---|---|---|---|---|
| 996,688 | A * | 7/1911 | Vernon-Inkpen | 405/254 |
| 1,258,482 | A * | 3/1918 | Shuman | 405/233 |
| 1,848,339 | A * | 3/1932 | Geiger | 405/233 |
| 3,243,927 | A * | 4/1966 | Hilson | 52/169.9 |
| 3,277,968 | A * | 10/1966 | Grimaud | 173/216 |
| 3,621,663 | A * | 11/1971 | Otani | 405/231 |
| 3,636,718 | A * | 1/1972 | Keats | 405/248 |
| 3,971,227 | A * | 7/1976 | Godley | 405/233 |
| 4,239,419 | A * | 12/1980 | Gillen, Jr. | 405/232 |
| 4,405,262 | A * | 9/1983 | Nagashima | 405/221 |
| 4,504,173 | A * | 3/1985 | Feklin | 405/240 |
| 4,543,015 | A * | 9/1985 | Kruse | 405/256 |
| 4,627,769 | A | 12/1986 | Lee | |
| 4,644,715 | A * | 2/1987 | Burell et al. | 52/170 |
| 4,650,372 | A * | 3/1987 | Gorrell | 405/232 |
| 4,911,581 | A * | 3/1990 | Mauch | 405/232 |
| 5,288,175 | A | 2/1994 | Knight | |
| 5,433,557 | A | 7/1995 | Houghton | |
| 5,509,759 | A | 4/1996 | Keesling | |
| 5,722,498 | A * | 3/1998 | Van Impe et al. | 175/394 |
| 5,875,860 | A * | 3/1999 | Coelus | 175/323 |
| 5,934,835 | A | 8/1999 | Whitty, Jr. et al. | |
| 6,264,403 | B1 * | 7/2001 | Hall et al. | 405/252.1 |
| 6,283,231 | B1 * | 9/2001 | Coelus | 175/323 |
| 6,402,432 | B1 * | 6/2002 | England et al. | 405/232 |
| 6,471,445 | B2 * | 10/2002 | Stansfield | 405/232 |
| 6,592,300 | B2 | 7/2003 | Yang et al. | |
| 6,665,990 | B1 * | 12/2003 | Cody et al. | 52/295 |
| 6,948,884 | B2 * | 9/2005 | Xu et al. | 405/216 |
| 2002/0168232 | A1 * | 11/2002 | Xu et al. | 405/224 |

* cited by examiner

*Primary Examiner*—Carl D. Friedman
*Assistant Examiner*—Gay Ann Spahn
(74) *Attorney, Agent, or Firm*—Fulbright & Jaworski, L.L.P.

(57) ABSTRACT

A foundation pile or pile segment is described that provides support for a structure such as a building foundation. The pile includes a generally solid body having a top end wall, a bottom end wall adapted for providing end load bearing capacity, and all around sidewalls. The sidewalls extend between the top end wall and the bottom end wall and has at least a pair of oppositely disposed spiral ridges that extend generally about the surface of the sidewalls. Further, each spiral ridge extends in a generally spiral direction from the top end wall to the bottom end wall. The spiral ridges provide an offset surface that extends generally outward from the surface of the sidewalls. The offset surfaces provide additional load bearing capacity to the foundation pile.

17 Claims, 2 Drawing Sheets

FOUNDATION PILE HAVING A SPIRAL RIDGE

BACKGROUND OF THE INVENTION

The present invention relates generally to an apparatus and method for supporting above-ground structures and/or repairing structural foundations. More particularly, the invention relates to an apparatus and system that includes a foundation pile segment, or a plurality of corresponding foundation pile segments, having enhanced supporting or underpinning capacity. The invention further relates to a method of support installation or underpinning utilizing such a pile or piles, whereby the pile is driven vertically into the earth.

Foundation pile segments, or simply, foundation piles, are driven into and installed in the earth to transfer thereto, the loads applied to or resulting from above-ground structures such as buildings, slabs, walls and columns. An installed foundation pile obtains its load bearing capacity primarily from two surface areas: the bottom surface and the sidewall surfaces. The bottom surface provides the primary, direct end load bearing capacity. The sidewall surfaces, on the other hand, frictionally engages the adjacent soil to provide frictional surface areas that resist the downwardly directed load.

BRIEF SUMMARY OF THE INVENTION

A foundation pile apparatus according to the present invention is utilized to support an above-ground structure such as buildings, walls concrete, slabs, and columns. The inventive foundation pile includes a generally solid body (e.g., rounded, square or rectangular shaped, cylindrical, etc.) having a top end wall, a bottom end wall and all around sidewalls extending therebetween. In several embodiments, the body of the pile apparatus is precast concrete and further, has a generally rounded shape (i.e., a generally circular cross section). The sidewalls extend between the top end wall and the bottom end wall and has at least one (but, preferably two or more) spiral ridge that extends generally about, the surface of the sidewall. Further, this spiral ridge extends in a generally spiral direction from the top end wall to the bottom end wall. The spiral ridge provides an offset surface that extends generally outward from the surface of the sidewalls. The surface area of this offset surface significantly enhances the load bearing capacity of the pile.

For purposes of the present Description, the term "spiral" or "spirally" is used to refer to a direction in which the ridge traverses both circumferentially and downwardly about the sidewalls of the pile body. In various embodiments of the invention, the spiral ridge may traverse up to or less than one-quarter of the circumference, and even the full circumference or beyond. The spiral ridge may also traverse the full height of the pile body, a distance less than the full height, and/or a distance less than the full height and in between the end walls In another aspect of the present invention, a method of installing foundation piles for supporting an above-ground structure is provided. The inventive method includes the step of providing a foundation pile apparatus such as that described above. The foundation pile apparatus is driven into unexcavated earth a desired distance and set a desired depth, whereby said offset surface and said end wall support a load on said pile apparatus. Preferably, a downward force is applied upon the foundation pile (e.g., upon a top end wall), whereby the pile apparatus moves downwardly and rotatably into the unexcavated earth. In this driving step, the pile may rotate about ¼ turn for every given downward distance into the earth (wherein the given downward distance corresponds to about the height of the pile). Moreover, in rotating the pile, the spiral ridge preferably loosens the soils adjacent the pile as the pile is driven downwardly into the earth, thereby facilitating and making more efficient the driving step.

These and other objects, features and advantages of the present invention will become apparent to those skilled in the art from the following detailed descriptions and the drawings.

DETAILED DESCRIPTION OF THE INVENTION

Each of FIGS. 1-4 illustrates a foundation pile (and method of installing same) embodying various aspects of the present invention. These particular foundation piles are illustrated and described herein for exemplary purposes. Variations of the foundation pile and methods of utilizing or installing the same, according to the invention, will become readily apparent to one skilled in the relevant structural or mechanical art upon reading the present Description and/or viewing the accompanying Drawings. Thus, the present invention should not be limited to the structures, systems, and methods described below.

Figure 1A:
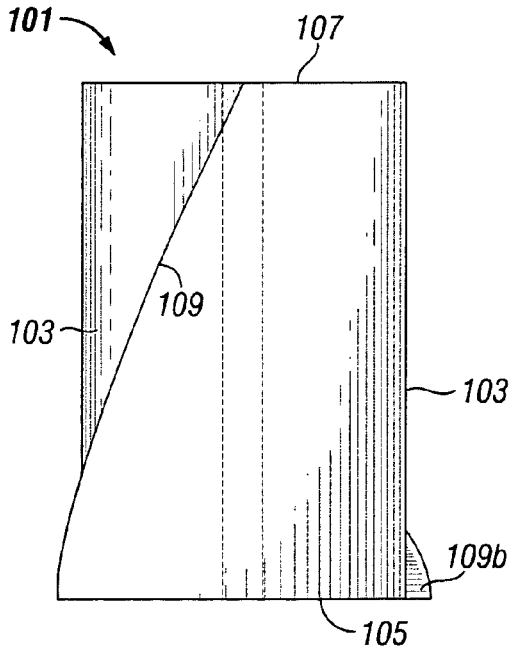
FIG. 1A is an elevation view of a foundation pile according to the present invention.

Referring to FIG. 1A, a foundation pile according to the present invention is depicted in the form of a precast concrete pile 101. The concrete pile 101 may be made from materials, mixtures, and components generally known in the art. The concrete pile 101 has a top end wall 105, a bottom end wall 107, and an all-around sidewall 113 extending therebetween. The top end wall 105 is designed to sustain a downwardly directed driving force (e.g., applied by hydraulic ram) during installation of the pile 101 into the soil or earth. The bottom end wall 107 is provided sufficient bottom surface area to meet certain end load bearing requirements of the pile 101 (also the cross-sectional area of the body must be sufficient for buckling and torsional loads). In the embodiment of FIG. 1A, the top end wall 105 and the bottom end wall 107 are generally identical, in that each has a flat surface of generally the same surface area. In further embodiments, the sidewall 113 may not be generally straight and the bottom end wall 107 may provide a larger and/or irregular surface area.

The foundation pile 101 of FIG. 1A also has an elongated bore or hole 111 that extends between the end walls 105, 107. The hole 111 accommodates a high strength strand for the foundation pile 101 that is used in a system of corresponding segmental piles. Such a system and corresponding method of installation are described and illustrated in U.S. Pat. No. 5,288,175 (which has been assigned to the assignee of the present invention)(hereby incorporated by reference for all purposes and made a part of the present disclosure).

The inventive foundation pile is particularly applicable for use in such a system and installation because, as will be further discussed below, the enhanced attributes of a single inventive foundation pile may be realized multi-fold in a multi-pile system.

In other embodiments of the invention, the foundation pile may be constructed of materials such as wood, metal, epoxy, or other materials generally known and used for foundation pile construction. In further embodiments, the foundation pile may take on other shapes including a generally square or rectangular configuration or a generally tapered or bell-shaped form. The shape of the concrete pile 101 in FIGS. 1-3 may, for purposes of the present invention, may be referred to as rounded or cylindrical.

Figure 1B:
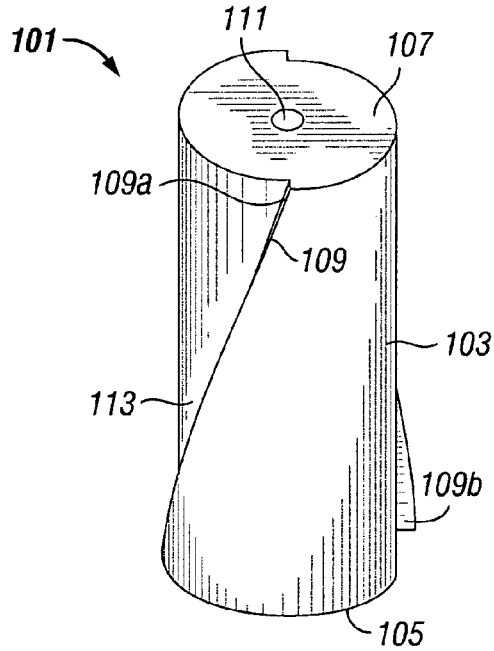
FIG. 1B is a perspective view of the foundation pile of FIG. 1A.
Figure 2:
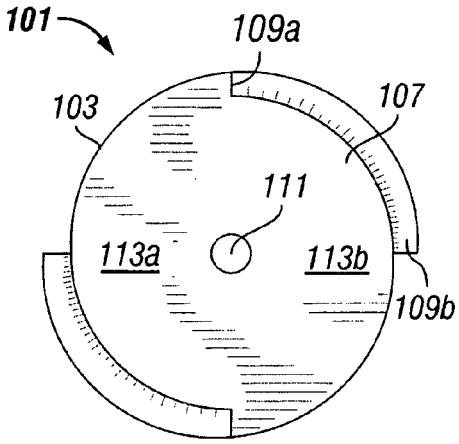
FIG. 2 is a bottom view of the pile apparatus of FIG. 1A.
Figure 3:
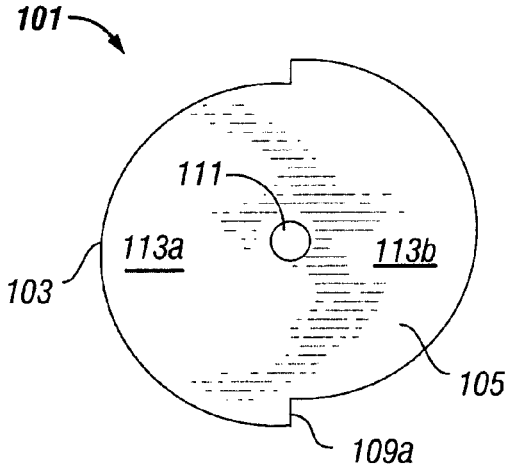
FIG. 3 is a top view of the pile apparatus of FIG. 1A.

In one unique aspect of the invention, the preferred concrete pile 101 is precast in a special-shaped mold. As illustrated by FIGS. 1-3, such a mold provides the inventive concrete pile 101 a pair of spiral ridges 109, each of which is directed or extends spirally downward about the sidewall 113 of the concrete body 103. The spiral ridge 109 preferably extends entirely from the top end wall 105 downwardly to the bottom end wall 107. As best shown in FIG. 2, all spiral ridge "according to the invention" is defined, at least partially, by a notch or offset 109*a* from the sidewall 113 that creates an offset surface 109*b* extending therefrom and which, as will be explained below, enhances the support capacity of the foundation pile 101. The pile 101 is preferably oriented, during installation, such that both offset surfaces 109*b* faces generally downward (rather than generally upward) or in the direction of rotation (denoted by "AA" in FIGS. 1 and 3).

With reference to FIGS. 2 and 3, the mold is shaped and sized such that the ridge 109 provides two complementary semi-circles of the concrete body 103. The complementary semi-circles 113*a* and 113*b* are offset by the width or depth of each notch 109*a*. As mentioned previously, the concrete pile 101 is preferably a precast molded body. To facilitate removal of the concrete body 103 from the mold, the concrete body 103 may be provided with a slight taper or curvature. In many applications, the molds, and thus the concrete piles 101, are typically 11 to 12 inches in height and about 6 inches in diameter. With these dimensions, a concrete pile having two spiral ridges is formed wherein the spiral ridges extend downwardly at about a 45° angle and horizontally traverses approximately 90° or one-fourth of the sidewall's circumference.

Because of the 45° angle of the spiral ridge 109, the round shaped pile 101 may be driven vertically downward into the unexcavated earth in a manner that produces a quarter turn (or 90° turn) with each distance equaling the height of the pile. In this way, a concrete pile 101 having a height of 12" and a diameter of 6' rotates about ¼ turn or 90° or for every 11-12" penetration into the soil. Moreover, the spiral ridge 109 provides a facilitating function during installation of the pile 101. Specifically, as the pile 101 is impacted by a generally vertical downward force (i.e., from a hammer or hydraulic ram) on the top end wall 105, the spiral ridge 109 causes the soil immediately in front of the offset surface 109*b*, and adjacent the sidewall 113 and bottom end wall 107, to loosen. In this way, the resistance of the soil to downward movement of the pile 101 into the earth is reduced. It has been observed by the Applicant that a concrete pile 101, such as the embodiment depicted in FIGS. 1-3, may be driven or moved deeper into the earth than a traditionally shaped and sized pile (i.e., without the spiral ridge 109). Tests were conducted to measure the relative soil or ground penetration obtained by the inventive pile (as shown in FIGS. 1-3) and the traditional prior art pile when the same downward force is applied to both and in similar solid conditions. These tests showed that the inventive pile is driven a depth that is about 18% deeper than the depth to which the prior art pile is driven.

In addition to the benefit of driving a pile deeper and faster into the earth, the inventive pile also allows for more segmental piles to be installed in one location. Accordingly, a system of such piles provides even greater support to the above-ground structure.

It will be apparent to one skilled in the art that other dimensions of the pile apparatus, of concrete or other material, may be obtained as required. For example, concrete piles may be made shorter and smaller than the 12" high and 6" diameter piles depicted in the Figures. It will also be apparent to those skilled in the art that there may be certain practical limitations, i.e., strength, to the size and dimensions of the pile design.

Figure 4:
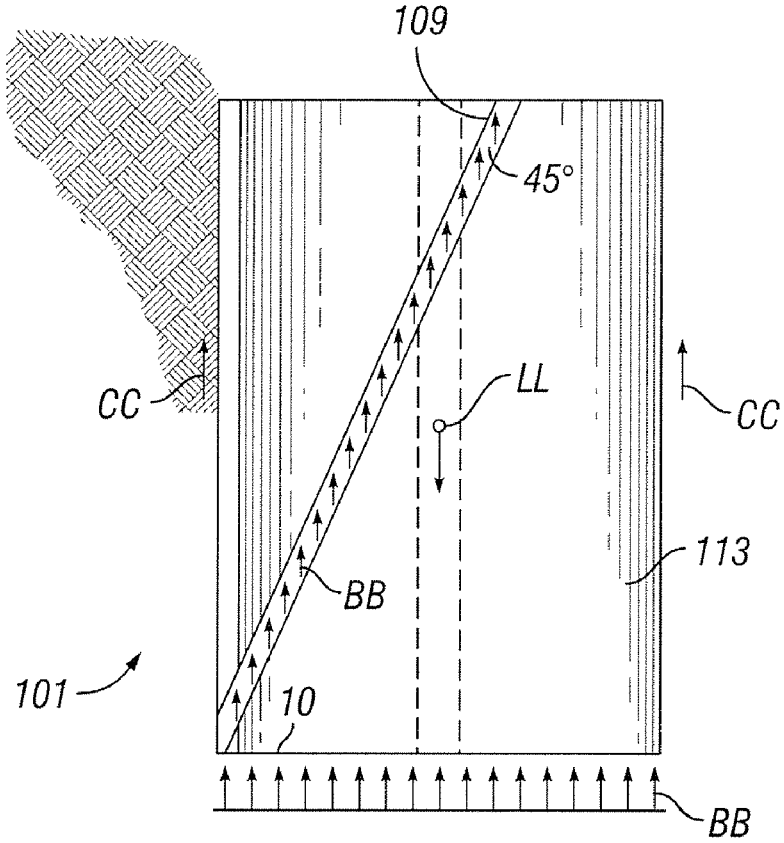
FIG. 4 is the elevation view of FIG. 1A modified as a simplified force-body diagram in accordance with the present invention.

Now also referring to FIG. 4, the foundation pile 101 according to the invention is provided with structural features that enhance the supporting capacity of the pile (as well as facilitate its installation). In particular, the inventive foundation pile 101 is equipped with the structurally advantageous spiral ridge 109. The spiral ridge 109 provides an additional load bearing surface in the form of the offset surfaces 109*b*. The offset surfaces 109*b* supplement the bearing capacity of the end wall 107 to increase the overall load bearing capacity of the foundation pile 101 (which is also supplemented by the frictional surface area provided by the sidewall). This is illustrated by the simplified force-body diagram of FIG. 4, wherein the resistant force or load bearing capacity of these surfaces is denoted by "BB", the frictional forces denoted by "CC", and the vertical load imparted on the pile 101 is denoted by LL. With respect to the foundation pile 101 of FIGS 1-3, a spiral ridge that is 12" long and ½" wide provides an additional load bearing surface of 6 square inches, or a total of 12 square inches for two spiral ridges. In contrast, if the foundation pile of FIGS. 1-3 did not have the spiral ridges (as in the prior art), its end load bearing surface would be provided by the end wall surface area or approximately 28 square inches (e.g.), $\pi R^2$, where R=3". Thus, a foundation pile according to the invention provides 1.5 times more load bearing capacity than the end wall of a corresponding prior art foundation pile—as a result of the spiral ridge.

A system of corresponding or segmental piles further illustrates the advantage provided by the inventive foundation pile. In such systems and installations, it is not uncommon to drive fifteen foundation piles into the earth. Thus, in accordance with the inventive method, fifteen piles may be driven to provide an additional end bearing surface capacity of 180 square inches (12 square inches×15 piles). As a result, in a method according to the invention, the series of piles may be driven deeper into the earth and provide greater end bearing capabilities. Moreover, with the greater depth, greater stability may be achieved because the concrete piles or at least more of the concrete piles may be driven into non-weather affected zones of the earth. Still further, with piles driven into the earth, the system of piles provides greater frictional surface wear (because of the additional piles). These are just some of the important advantages and benefits afforded to one employing the method according to the invention and the pile apparatus according to the invention.

The systems, apparatus, and methods described herein are particularly adapted for installation of a pile segment in a system of piles, e.g., segmental piles, and preferably, concrete or wooden piles. However, it would be apparent to one skilled in the relevant mechanical or structural art upon reading the Description and viewing the accompanying Drawings, that the various aspects of the invention are also applicable to other structural or foundation support systems. For example, the foundation pile and method of installing same, may be adapted for single pile installations or multiple installation (e.g., segmental piles). Moreover, the foundation pile segment may be constructed of materials other than concrete or wood, may take on other shapes such as square, rectangular, or bell-shaped. Further yet, the piles may have more than two spiral ridges or a single spiral ridge that traverses the entire circumference of side wall one or more times.

Thus, the foregoing description is presented for purposes of illustration and description, and is not intended to limit the invention to the forms disclosed herein. Consequently, variations and modifications commensurate with the above teachings and the teaching of the relevant art are within the spirit of the invention. Such variations will readily suggest themselves to those skilled in the relevant structural or mechanical art. Further, the embodiments described are also intended to explain the best mode for practicing the invention, and to enable others skilled in the art to utilize the invention and such or other embodiments and with various modifications required by the particular applications or uses of the invention. It is intended in the appended claims be construed to include alternative embodiments to the extent that is permitted by prior art.

What is claimed is:

1. A foundation pile for providing support to an aboveground structure, said foundation pile comprising:

a cylindrical concrete body having a top end wall, a bottom end wall adapted for providing load bearing capacity, and a sidewall extending between said top end wall and said bottom end wall, said sidewall having two spiral ridges extending generally about said sidewall and integral to said sidewall, wherein each said spiral ridge has an offset surface extending generally outward from a surface of said sidewall, said offset surface providing additional load bearing capacity, and being generally unopposed by another offset surface between said top end wall and said bottom end wall.

2. The foundation pile of claim 1, wherein said concrete body is a precast concrete body formed to include two vertical section halves, said section halves mutually facing one another in an offsetting manner to create said offset surfaces that form said spiral ridges.

3. The foundation pile of claim 2, wherein each said spiral ridge extends spirally downward about said sidewall and traverses horizontally about said sidewall an arc distance of about 90°, and wherein each said offset surfaces together has a load bearing surface of greater than about 0.33 times the load bearing surface of said bottom end wall.

4. A foundation pile for providing support to a slab, said foundation pile comprising:

a generally cylindrical solid body having, a top end wall, a bottom end wall adapted for providing load bearing capacity, a sidewall extending between said top end wall and said bottom end wall, said sidewall having a ridge extending generally about said sidewall and integral to said sidewall, wherein said ridge has an offset surface extending generally outward from a surface of said sidewall, said offset surface providing additional load bearing capacity and being generally unopposed by another offset surface between said top end wall and said bottom end wall; and a concrete slab, said foundation pile engaged with said slab.

5. The foundation pile of claim 4, wherein said ridge is a spiral ridge extending in a generally downward spiral direction about said sidewall.

6. The foundation pile of claim 4, wherein said sidewall includes a second ridge extending generally about said sidewall.

7. The foundation pile of claim 6, wherein said generally solid body is a precast concrete body formed to include section halves, said section halves mutually facing one another in an offsetting manner to create said offset surface and a second offset surface that form said first and second ridges.

8. The foundation pile of claim 4, wherein said ridge extends spirally substantially the entire distance between said top end wall to said bottom end wall.

9. The foundation pile of claim 5, wherein said body includes a second spiral ridge, each said ridge traversing horizontally about said sidewall an arc distance of about 90°.

10. The foundation pile of claim 5, wherein said body includes a second spiral ridge, each said ridge with offset surfaces, said offset surfaces providing a load bearing surface that is between about 0.35 to 0.55 times the load bearing surface of said bottom end wall.

11. A foundation pile supporting a building, said foundation pile comprising:

a generally cylindrical solid body having, a top end wall, a bottom end wall adapted for providing load bearing capacity, a sidewall extending between said top end wall and said bottom end wall, said sidewall having a ridge extending generally about said sidewall and integral to said sidewall, wherein said ridge has an offset surface extending generally outward from a surface of said sidewall, said offset surface providing additional load bearing capacity; and said foundation pile engaged with said building.

12. The foundation pile of claim 11, wherein said ridge is a spiral ridge extending in a generally downward spiral direction about said sidewall.

13. The foundation pile of claim 11, wherein said sidewall includes a second ridge extending generally about said sidewall.

14. The foundation pile of claim 13, wherein said generally solid body is a precast concrete body formed to include section halves, said section halves mutually facing one another in an offsetting manner to create said offset surface and a second offset surface that form said first and second ridges.

15. The foundation pile of claim 11, wherein said ridge extends spirally substantially the entire distance between said top end wall to said bottom end wall.

16. The foundation pile of claim 12, wherein said body includes a second spiral ridge, each said ridge traversing horizontally about said sidewall an arc distance of about 90°.

17. The foundation pile of claim 12, wherein said body includes a second spiral ridge, each said ridge with offset surfaces, said offset surfaces providing a load bearing surface that is between about 0.35 to 0.55 times the load bearing surface of said bottom end wall.

* * * * *